US005615464A

United States Patent [19]

Rojdev

[11] Patent Number: 5,615,464

[45] Date of Patent: Apr. 1, 1997

[54] LIQUID RETAINING SYSTEM FOR CASKET

[75] Inventor: Ilija Rojdev, Fairfield, Ohio

[73] Assignee: Batesville Casket Company, Inc., Batesville, Ind.

[21] Appl. No.: 409,342

[22] Filed: Mar. 23, 1995

[51] Int. Cl.[6] ..... A61G 17/04

[52] U.S. Cl. ..... 27/19; 27/7; 27/11; 27/12

[58] Field of Search ..... 27/19, 18, 11, 27/12, 2, 3, 7

[56] References Cited

U.S. PATENT DOCUMENTS

| | | | |
|---|---|---|---|
| Re. 33,971 | 6/1992 | Wolfe . | |
| Re. 34,846 | 2/1995 | McGuire . | |
| 58,756 | 2/1866 | Scollay . | |
| 194,530 | 8/1887 | Nirdlinger | 27/19 |
| D. 341,012 | 11/1993 | Baird . | |
| 675,679 | 6/1901 | Shaw . | |
| 797,788 | 8/1905 | Adams | 27/12 |
| 1,027,453 | 5/1912 | Wible | 27/19 |
| 1,261,707 | 4/1918 | Cook . | |
| 1,431,827 | 10/1922 | Manning | 27/3 X |
| 2,247,617 | 7/1941 | Metz . | |
| 2,882,584 | 4/1959 | Kidd . | |
| 3,435,494 | 4/1969 | Bernard . | |
| 3,488,818 | 1/1970 | Orr . | |
| 3,653,104 | 4/1972 | Nelson | 27/12 |
| 3,692,267 | 9/1972 | Kronas | 27/12 X |
| 3,964,140 | 6/1976 | Gauchard . | |
| 4,404,716 | 9/1983 | Faust | 27/12 |
| 4,448,826 | 5/1984 | Davidian . | |
| 4,524,472 | 6/1985 | Faust | 27/12 X |
| 4,621,395 | 11/1986 | Benoit | 27/12 |
| 4,780,940 | 11/1988 | Jay . | |
| 4,827,581 | 5/1989 | Davidian . | |
| 4,949,439 | 8/1990 | Semon . | |
| 4,951,367 | 8/1990 | Wolfe . | |
| 5,092,020 | 3/1992 | MaGuire . | |
| 5,121,529 | 6/1992 | McClure . | |
| 5,140,728 | 8/1992 | Chandler et al. . | |
| 5,201,980 | 4/1993 | Chandler et al. . | |
| 5,222,281 | 6/1993 | Guerin . | |
| 5,231,741 | 8/1993 | Maguire | 27/12 |
| 5,245,733 | 9/1993 | Goria . | |
| 5,301,398 | 4/1994 | Bursey, Jr. . | |
| 5,321,873 | 6/1994 | Goria . | |

FOREIGN PATENT DOCUMENTS

| | | |
|---|---|---|
| 1151167 | 1/1958 | France . |
| 2532544 | 3/1984 | France . |
| 2538698 | 7/1984 | France . |
| 2590796 | 12/1985 | France . |
| 2626245 | 7/1989 | France . |
| 2719154 | 11/1978 | Germany . |
| 4225266 | 2/1993 | Germany . |
| 2206334 | 1/1989 | United Kingdom . |

*Primary Examiner*—Carl D. Friedman
*Assistant Examiner*—Robert J. Canfield
*Attorney, Agent, or Firm*—Wood, Herron & Evans

[57] ABSTRACT

A combination of a casket and a liquid retaining system for the casket comprises a casket shell, a body support structure mounted in the casket adapted to support a deceased thereon and a tray positioned atop the body support structure and adapted to be positioned beneath the deceased supported on the body support structure, and a tray for retaining liquids of decomposition of the deceased. The liquid retaining system may further include a liner supported atop the tray bottom wall and beneath the deceased and secured to the upper edges of the side and end walls of the casket shell.

25 Claims, 2 Drawing Sheets

LIQUID RETAINING SYSTEM FOR CASKET

FIELD OF THE INVENTION

This invention related generally to burial caskets, and more particularly to a liquid retaining system for a burial casket for retaining liquids of decomposition of a deceased.

BACKGROUND OF THE INVENTION

Decomposition of human remains generates liquids that accumulate in the bottom of the casket. These liquids present a number of problems. For example, due the presence of formalin solution in embalming, there can be the presence of extremely corrosive formic acid in the liquids, as well as other corrosive materials. Bacteria, enzymes, etc. are also present in the liquid. Formic acid is extremely corrosive to metals, for example, carbon steel, stainless, copper and its alloys, presenting the risk of casket failure and leakage due to corrosion.

Wooden caskets, because of the inherent nature of the material and methods of construction, are not leakproof. Liquids which accumulate can readily escape to the outside creating problems of leakage before interment and also for interment in mausoleums and crypts.

Three prior solutions to this problem are disclosed in Semon U.S. Pat. No. 4,949,439, Wolfe U.S. Pat. No. RE33, 971, and Maguire U.S. Pat. No. RE34,846. These patents disclose, respectively, a drip pan for a casket, a casket liner and a liquid retaining tray for a casket, all of which are installed in the bottom of the casket below the body support structure. Each of these designs requires the pan, liner or tray to be installed in the casket bottom prior to installing the body support structure in the casket. Thus, these prior solutions are not readily retrofittable into existing, already fabricated caskets. In addition, depending on the wall height of the pan, liner or tray, and the particular body support structure mounting means employed in the casket, it may be necessary to pierce the end walls of the pan, liner or tray with fasteners in order to secure the body support structure to the casket shell end walls, thus creating opportunities for leakage at the points where the fasteners pierce the pan, liner or tray end walls.

It is therefore an objective of the present invention to provide a liquid retaining system for a casket which is readily retrofitted into existing, prefabricated caskets.

It is another objective of the present invention to provide a liquid retaining system for a casket which does not require that a portion of the system be pierced with fasteners in order to secure the body support structure to the walls of the casket.

SUMMARY OF THE INVENTION

The present invention attains the stated objectives by providing a combination of a casket and a liquid retaining system for the casket. The combination comprises a casket shell, a body support structure mounted in the casket shell adapted to support a deceased thereon and a tray positioned atop the body support structure and adapted to be positioned beneath the deceased supported on the body support structure, the tray for retaining liquids of decomposition of the deceased.

In a preferred embodiment of the present invention, the body support structure includes a bed frame having a pair of longitudinal side rails and a pair of transverse end rails connected to the side rails. All the rails are angle sections each having a vertical leg and a horizontal leg. The tray includes a bottom wall, longitudinal side walls connected to the bottom and side walls. The tray side and end walls confront the vertical legs of the bed frame side and end rails. The tray bottom wall is supported atop the horizontal legs of the bed frame side and end rails.

Further preferably, the body support structure includes brace members connected between the bed frame side rails and wire mesh spanning the bed frame. The tray bottom wall is supported atop the brace members and wire mesh, and includes a network of upstanding ribs which fit over the brace members and wire mesh. The tray is preferably fabricated of plastic.

Still further preferably, the tray side and end walls form a portion of a downturned channel section which fits over the vertical leg of the bed frame side and end rails, and the tray includes an upturned channel section peripherally outboard of the downturned channel section.

In another aspect of the present invention, the liquid retaining system further includes a liner supported atop the tray bottom wall, beneath the deceased and secured to the upper edges of the shell side and end walls. The liner is preferably fabricated from plastic. The tray includes a peripheral vertical wall having a free edge which supports the liner.

One advantage of the present invention is that a liquid retaining system for a casket is provided which may be readily retrofitted into existing or preassembled caskets without any disassembly of the existing casket being required.

Another advantage of the present invention is that a liquid retaining system for a casket is provided which is not required to be pierced by fasteners in order to install the body support structure within the casket shell.

These and other objects and advantages of the present invention will become more readily apparent during the following detailed description taken in conjunction with the drawings herein, in which:

DETAILED DESCRIPTION OF THE INVENTION

Figure 1:
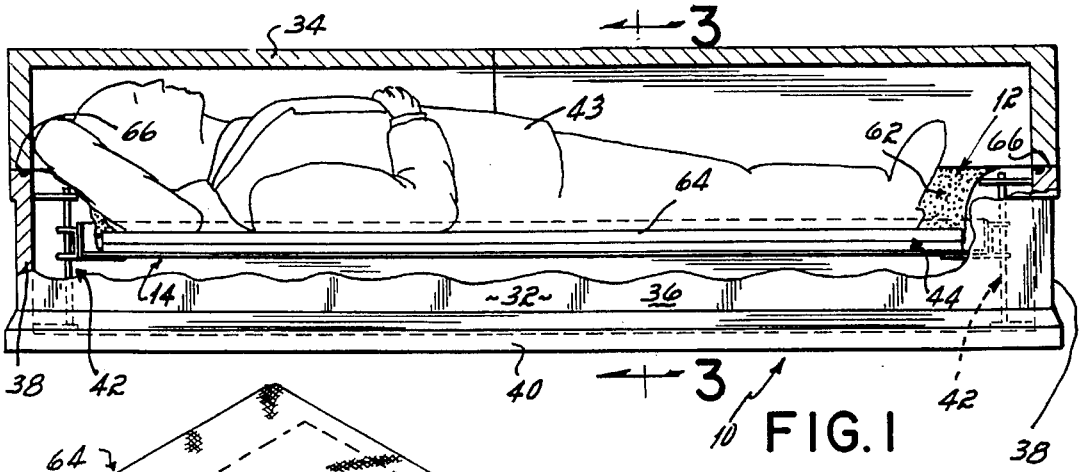
FIG. 1 is a side elevational view, in partial cross-section, of a casket and liquid retaining system of the present invention.

Referring first to the Figs., there is illustrated a casket 10 and liquid retaining system 12 according to the principles of the present invention.

The casket 10 includes a body support structure 14. Body support structure 14 includes a bed frame 16 having a pair of longitudinal side rails 18, 18 and a pair of transverse end rails 20, 20 connected to the side rails 18, 18. All of the rails 18 and 20 are angle sections each having a vertical leg 22 and a horizontal leg 24. Body support structure 14 may further include brace members 25 connected between the bed frame side rails 18, 18 and wire mesh 26 spanning the bed frame 16. Wire mesh 26 includes a plurality of longitudinal wire strands 28 as well as a plurality of transverse wire strands 30. Coil springs 31 attached the wire mesh 26 to the bed frame end rails 20, 20.

Casket 10 includes a lower casket shell 32 and a cap 34 pivotally attached to the shell 32 by means not shown but known to those skilled in the art. Shell 32 includes longitudinal side walls 36, 36, transverse end walls 38, 38 connected to the side walls 36, 36 and a bottom 40 to which is connected walls 36, 38. Body support structure 14 may be connected to the end walls 38, 38 and/or bottom 40 of shell 32 by suitable lift/tilt structure 42 known to those skilled in the art for raising and lowering the support structure 14 and/or tilting the head end of structure 14 for proper presentation of a deceased 43.

Liquid retaining system 12 may include a tray 44 positioned atop the body support structure 14 and adapted to be positioned beneath the deceased 43 supported on the body support structure 14 for retaining the liquids of decomposition of the deceased 43. The tray 44, preferably fabricated of plastic, for example polypropylene, includes a bottom wall 46, longitudinal side walls 48, 48 connected to the bottom wall 46 and transverse end walls 50, 50 connected to the bottom 46 and side 48, 48 walls.

Figure 3:
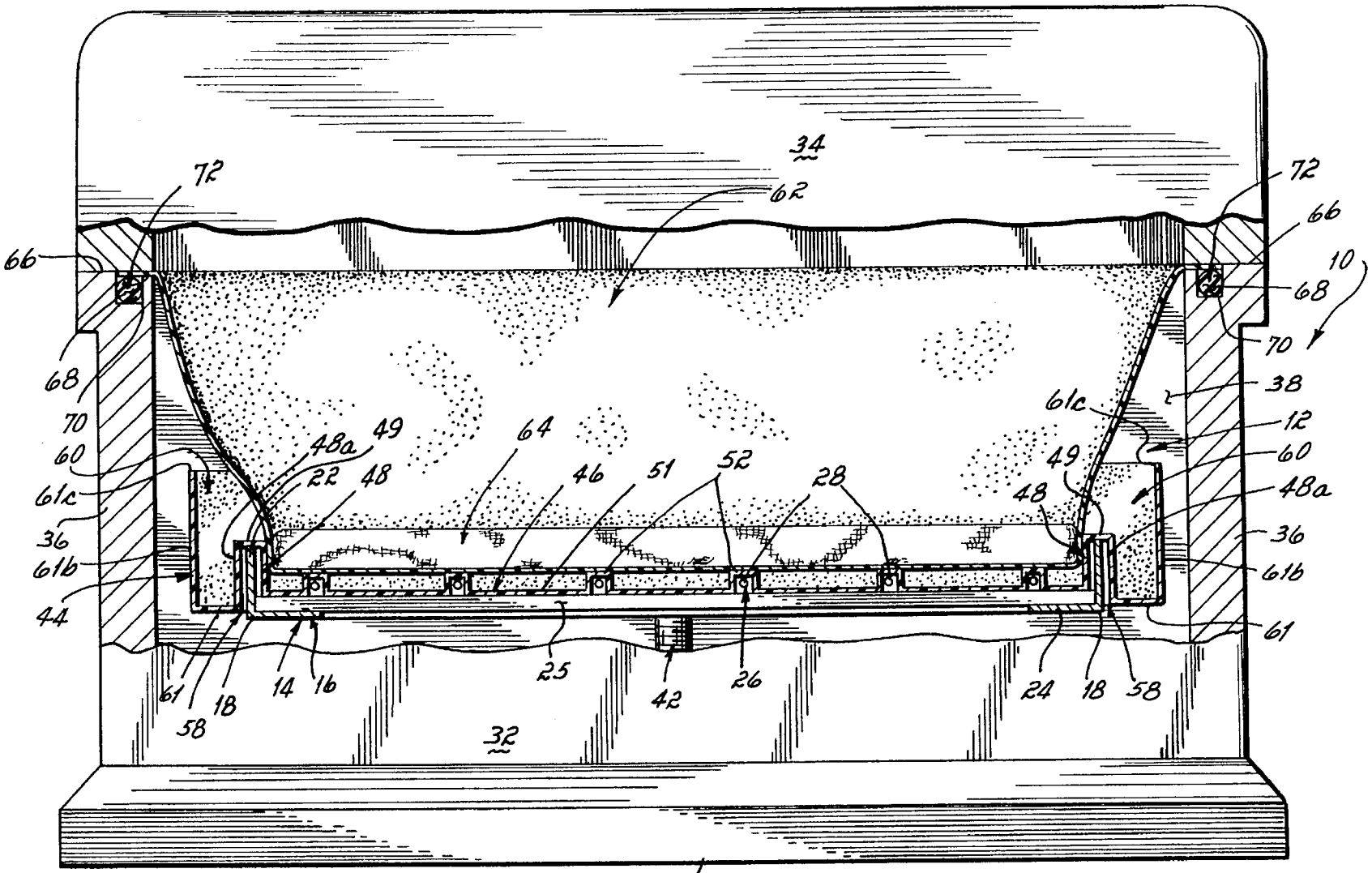
FIG. 3 is a cross-sectional view taken along line 3—3 of FIG. 1.

As best seen in FIG. 3, when tray 44 is positioned on body support structure 14, side walls 48 of tray 44 confront the vertical legs 22 of the side rails 18. Similarly, though not shown in FIG. 3, end walls 50 of tray 44 confront the vertical legs 22 of the end rails 20. The bottom wall 46 of tray 44 is supported atop the horizontal legs 24 of the bed frame side and end rails 18 and 20.

Figure 2:
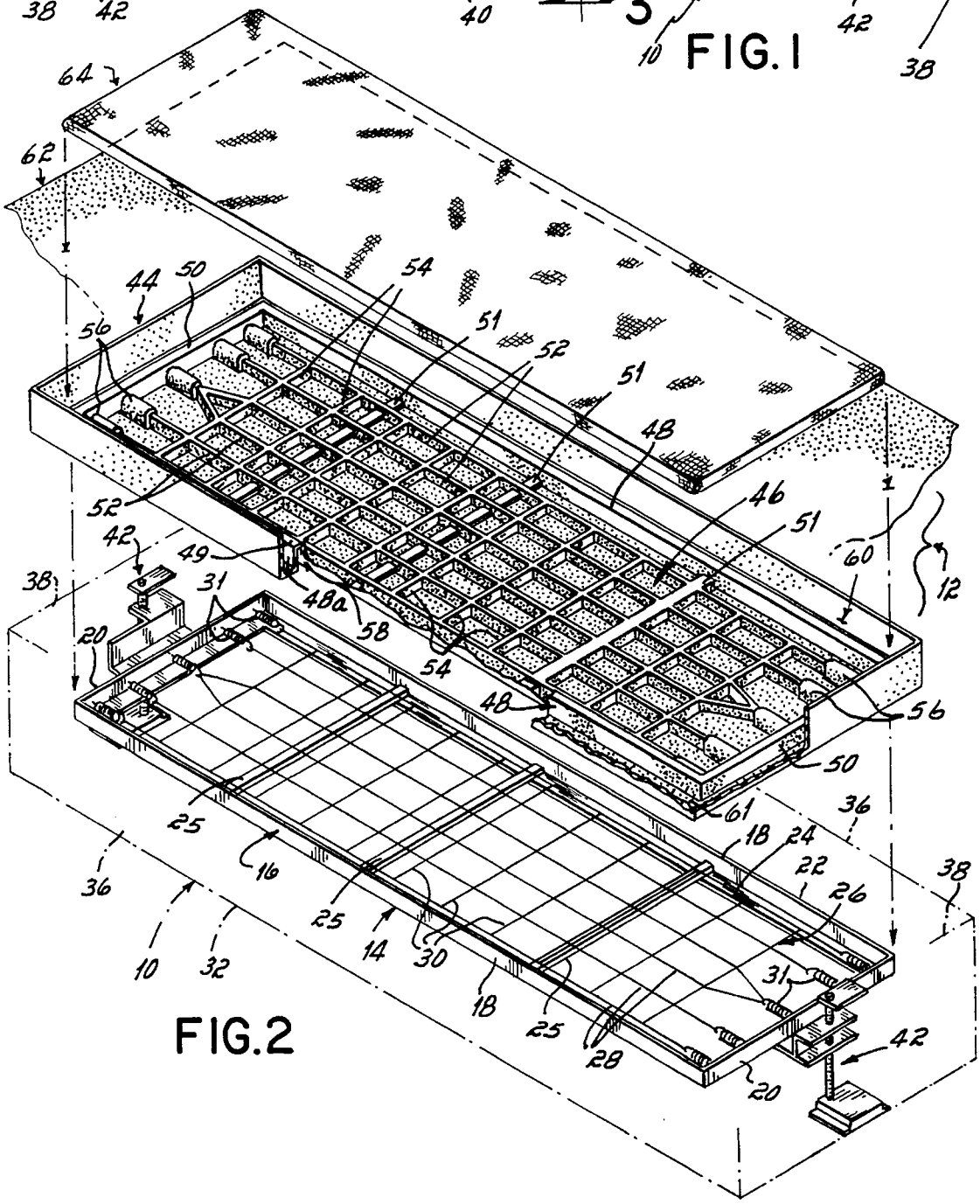
FIG. 2 is an exploded perspective view of the casket and liquid retaining system of FIG. 1.

Referring now to FIGS. 2 and 3, tray 44 includes upstanding transverse ribs 51 which correspond to each brace member 25 of the body support structure 14. Similarly, tray 44 includes longitudinal upstanding ribs 52 and transverse upstanding ribs 54 which correspond to longitudinal wire strands 28 and transverse wire strands 30 of the wire mesh 26 spanning the bed frame 16. Similarly, molded semicircular recesses 56 correspond to coil springs 31 attaching wire grid 26 to end rails 20. Thus the ribs 51, 52 and 54 and semicircular sections 56 fit over the brace members 24, longitudinal and transverse wire strands 28 and 30 and coil springs 31, respectively, with the periphery of the tray 44 residing atop the horizontal legs 24 of the bed frame side and end rails 18 and 20 as described above. In the alternative, wire mesh 26 and/or transverse brace members 25 may be eliminated from the bed frame 16, the network of upstanding ribs of the tray 44 providing sufficient stiffness to support the deceased within the perimeter of the bed frame 16.

Referring now to FIG. 3, it will be seen that the side walls 48 of tray 44 form a part of a downturned channel section 58. Downturned channel section 58 is comprised of the vertical side wall 48, a horizontal top wall 49 and another vertical wall 48*a*, and fits over the vertical leg 22 of the bed frame side rails 18. Tray end walls 50 are similarly constructed and include a similar downturned channel section (not shown in FIG. 3) which fits over the vertical leg 22 of the bed frame end rails 20. The tray side 48 and end 50 walls further include an upturned channel section 60 located peripherally outboard of the downturned channel section 58 which is comprised of vertical wall 48*a*, horizontal bottom wall 61 and another vertical wall 61*b* having a free edge 61*c* for a purpose which will be described below. Wall 48 is preferably approximately 1.5 inches high and wall 61*b* is preferably approximately 4 inches high. Wall 61*b* including its free edge 61*c* is spaced from and does not contact casket shell side and end walls 36, 38.

The liquid retaining system 12 may further include a liner 62 supported atop the tray bottom 46 in a position beneath a mattress 64 positioned within tray 44. Liner 62 is preferably a flexible plastic, for example co-extruded polypropylene sheet, liner and is secured to the upper edges 66 of the shell side 36 and end 38 walls. Liner 62 may be stapled to fibrous material 68 located within channel 70 in edge 66 by staples, one of which is shown at 72. Alternatively, liner 62 could be adhesively secured to edge 66 as by gluing, etc. Liner 62 provides further protection against liquids of decomposition finding their way to the bottom of the casket 10 during movement, tilting and the like of the casket during handling of the casket. Also, liner 62 prevents liquids from gathering below tray 44 as may happen with thermal cycling in mausoleums. Further, plastic liner 62, being flexible, readily allows for the body support structure 14 to be raised, lowered and tilted to position the deceased as desired without creating any additional loading on the lift and/or left/tilt mechanisms 42 or otherwise inhibiting these support structure 14 movements. Free edge 61*c* of wall 61*b* of channel 60 provides support for liner 62 in the event that the casket 10 becomes tilted causing liquid to run from the bottom of the tray 44 towards the top of the casket 10 and aids in redirecting these liquids back into the bottom of the tray 44 once the casket 10 is uprighted.

In use, the entire casket is assembled as is traditional. Thereafter the conventional interior trim of the casket, for example, big body, small body and the like, are then folded back or out of the casket shell 31 to reveal the body support structure 14 with mattress 64 thereatop. Mattress 64 is simply removed from atop the body support structure 14 and tray 44 is placed atop the body support structure 14. Plastic liner 62 is then placed atop the tray 44 and is secured to the edges 66 of the walls 36 and 38 of the casket shell 32. Mattress 64 is then placed atop the liner 62 and tray 44. The interior trim components of the casket, for example, big body, small body and the like, are then folded back into the casket concealing the tray 44 and liner 62.

Those skilled in the art will readily recognize numerous adaptations and modifications which can be made to the casket and liquid retaining system of the present invention which will result in an improved casket and liquid retaining system, yet all of which will fall within the spirit and scope of the present invention as defined in the following claims. For example, the invention may be employed in both metal and wood caskets. Accordingly, the invention is to be limited only by the scope of the following claims and their equivalents.

What is claimed is:

1. A combination of a casket and a liquid retaining system for said casket, said combination comprising:

a casket shell having side and end walls and a bottom wall secured to said side and end walls;

a body support structure mounted in said casket shell and spaced above said bottom wall and adapted to support a deceased thereon; and a tray positioned atop said body support structure and adapted to be positioned beneath the deceased supported on said body support structure, said tray for retaining liquids of decomposition of the deceased.

2. A combination of a casket and a liquid retaining system for said casket, said combination comprising:

a casket shell;

a body support structure mounted in said casket shell adapted to support a deceased thereon; and a tray positioned atop said body support structure and adapted to be positioned beneath the deceased supported on said body support structure, said tray for retaining liquids of decomposition of the deceased;

wherein:

said body support structure includes a bed frame having a pair of longitudinal side rails and a pair of transverse end rails connected to said side rails, all of said rails being angle sections each having a vertical leg and a horizontal leg;

said tray includes a bottom wall, longitudinal side walls connected to said bottom wall and transverse end walls connected to said bottom and side walls;

said tray side and end walls confronting said vertical legs of said bed frame side and end rails.

3. The combination of claim 2 wherein said tray bottom wall is supported atop said horizontal legs of said bed frame side and end rails.

4. The combination of claim 3 wherein said body support structure further includes brace members connected between said bed frame side rails and wire mesh spanning said bed frame, said tray bottom wall being supported atop said brace members and wire mesh.

5. The combination of claim 4 wherein said tray bottom wall includes a network of upstanding ribs which fit over said brace members and wire mesh.

6. The combination of claim 1 wherein said tray is fabricated from plastic.

7. A combination of a casket and a liquid retaining system for said casket, said combination comprising:

a casket shell;

a body support structure mounted in said casket shell adapted to support a deceased thereon; and a tray positioned atop said body support structure and adapted to be positioned beneath the deceased supported on said body support structure, said tray for retaining liquids of decomposition of the deceased;

wherein:

said body support structure includes a bed frame having a pair of longitudinal side rails and a pair of transverse end rails connected to said side rails, all of said rails being angle sections each having a vertical leg and a horizontal leg;

said tray includes a bottom wall, longitudinal side walls connected to said bottom wall and transverse end walls connected to said bottom and side walls;

said tray side and end walls form a part of a downturned channel section which fits over said vertical leg of said bed frame side and end rails.

8. The combination of claim 7 wherein said tray includes an upturned channel section peripherally outboard of said downturned channel section.

9. The combination of claim 1 wherein:

each said shell side and end wall includes an upper edge;

said tray includes a bottom wall, longitudinal side walls connected to said bottom wall and transverse end walls connected to said bottom and side walls; and said liquid retaining system further includes a liner supported atop said tray bottom wall, adapted to be positioned beneath the deceased and secured to said upper edges of said shell side and end walls.

10. The combination of claim 9 wherein said tray includes a peripheral vertical wall having a free edge, said free edge adapted to support said liner.

11. The combination of claim 9 wherein said liner is fabricated from plastic.

12. A combination of a casket and a liquid retaining system for said casket, said combination comprising:

a casket shell;

a body support structure mounted in said casket shell adapted to support a deceased thereon, said body support structure including a bed frame having a pair of longitudinal side rails and a pair of transverse end rails connected to said side rails, all of said rails being angle sections each having a vertical leg and a horizontal leg; and a tray positioned atop said body support structure and adapted to be positioned beneath the deceased supported on said body support structure, said tray for retaining liquids of decomposition of the deceased, said tray including a bottom wall, longitudinal side walls connected to said bottom wall and transverse end walls connected to said bottom and side walls, said tray bottom wall being supported atop said horizontal legs of said bed frame side and end rails.

13. The combination of claim 12 wherein said tray bottom wall includes a network of upstanding stiffening ribs.

14. The combination of claim 12 wherein said tray is fabricated of plastic.

15. The combination of claim 12 wherein said tray side and end walls form a part of a downturned channel section which fits over said vertical leg of said bed frame side and end rails.

16. The combination of claim 15 wherein said tray includes an upturned channel section peripherally outboard of said downturned channel section.

17. The combination of claim 12 wherein:

said shell includes longitudinal side walls and transverse end walls connected to said side walls, each said shell wall including an upper edge; and said liquid retaining system further includes a liner supported atop said tray bottom wall, adapted to be positioned beneath the deceased and secured to said upper edges of said shell side and end walls.

18. A combination of a casket and a liquid retaining system for said casket, said combination comprising:

a casket shell;

a body support structure mounted in said casket shell adapted to support a deceased thereon, said body support structure including a bed frame having a pair of longitudinal side rails and a pair of transverse end rails connected to said side rails, all of said rails being angle sections each having a vertical leg and a horizontal leg; and a tray positioned atop said body support structure and adapted to be positioned beneath the deceased supported on said body support structure, said tray for retaining liquids of decomposition of the deceased, said tray including a bottom wall, longitudinal side walls connected to said bottom wall and transverse end walls connected to said bottom wall and side walls, said tray bottom wall being supported atop said horizontal legs of said bed frame side and end rails;

said shell including longitudinal side walls and transverse end walls connected to said side walls, each said shell wall including an upper edge;

said liquid retaining system further including a liner supported atop said tray bottom wall, adapted to be positioned beneath the deceased and secured to said upper edges of said shell side and end walls;

wherein said tray includes a peripheral vertical wall having a free edge, said free edge adapted to support said liner.

19. The combination of claim 17 wherein said liner is fabricated from plastic.

20. A combination of a casket and a liquid retaining system for said casket, said combination comprising:

a casket shell, said shell including longitudinal side walls and transverse end walls connected to said side walls, each said shell wall including an upper edge;

a body support structure mounted in said casket shell adapted to support a deceased thereon, said body support structure including a bed frame having a pair of longitudinal side rails and a pair of transverse end rails connected to said side rails, all of said rails being angle sections each having a vertical leg and a horizontal leg, said body support structure further including brace members connected between said bed frame side rails and wire mesh spanning said bed frame; and a plastic trap positioned atop said body support structure and adapted to be positioned beneath the deceased supported on said body support structure, said tray for retaining liquids of decomposition of the deceased, said tray including a bottom wall, longitudinal side walls connected to said bottom wall and transverse end walls connected to said bottom and side walls, said tray side and end walls confronting said vertical legs of said bed frame side and end rails, said tray bottom wall supported atop said horizontal legs of said bed frame side and end rails, said tray further including a network of upstanding ribs which fit over said brace members and wire mesh.

21. The combination of claim 20 wherein said tray side and end walls form a part of a downturned channel section which fits over said vertical legs of said bed frame side and end rails.

22. The combination of claim 20 wherein said liquid retaining system further includes a plastic liner supported atop said tray bottom wall, adapted to be positioned beneath the deceased and secured to said upper edges of said shell side and end walls.

23. A combination of a casket and a liquid retaining system for said casket, said combination comprising:

a casket shell, said shell including longitudinal side walls and transverse ends walls connected to said side walls, each said shell wall including an upper edge;

a body support structure mounted in said casket shell adapted to support a deceased thereon, said body support structure including a bed frame having a pair of longitudinal side rails and a pair of transverse end rails connected to said side rails, all of said rails being angle sections each having a vertical leg and a horizontal leg, said body support structure further including brace members connected between said bed frame side rails and wire mesh spanning said bed frame; and a plastic tray positioned atop said body support structure and adapted to be positioned beneath the deceased supported on said body support structure, said tray for retaining liquids of decomposition of the deceased, said tray including a bottom wall, longitudinal side walls connected to said bottom wall and transverse end walls connected to said bottom and side walls, said tray side and end walls confronting said vertical legs of said bed frame side and end rails, said tray bottom wall supported atop said horizontal legs of said bed frame side and end rails, said tray further including a network of upstanding ribs which fit over said brace members and wire mesh;

said liquid retaining system further including a plastic liner supported atop said tray bottom wall, adapted to be positioned beneath the deceased and secured to said upper edges of said shell side and end walls;

wherein said tray includes a peripheral vertical wall having a free edge, said free edge adapted to support said liner.

24. A combination of a casket and a liquid retaining system for said casket, said combination comprising:

a casket shell having side and end walls and a bottom wall secured to said side and end walls;

a body support structure mounted in said casket shell above said bottom wall adapted to support a deceased thereon;

a tray positioned atop said body support structure and adapted to be positioned beneath the deceased supported on said body support structure; and a liner supported atop said tray, adapted to be positioned beneath the deceased and secured to said shell;

said tray and liner for retaining liquids of decomposition of the deceased.

25. The combination of claim 24 wherein said tray includes a peripheral vertical wall having a free edge, said free edge adapted to support said liner.

* * * * *

UNITED STATES PATENT AND TRADEMARK OFFICE

CERTIFICATE OF CORRECTION

PATENT NO. : 5,615,464
DATED : April 1, 1997
INVENTOR(S) : Ilija Rojdev

It is certified that error appears in the above-indentified patent and that said Letters Patent is hereby corrected as shown below:

Column 3, line 1, "attached" should read -- attach --.

Column 4, line 17, "left/tilt" should read -- lift/tilt --.

Column 7, line 15, "a plastic trap" should read -- a plastic tray --.

Column 7, line 41, "transverse ends" should read -- transverse end --.

Signed and Sealed this

Twenty-first Day of October 1997

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,615,464

DATED : April 1, 1997

INVENTOR(S) : Ilija Rojdev

It is certified that error appears in the above-identified patent and that said Letters Patent is hereby corrected as shown below:

Column 4, line 51, insert -- substantially planar -- before "body support structure".

Signed and Sealed this

Nineteenth Day of May, 1998

Bruce Lehman

*Attest:*

BRUCE LEHMAN

*Attesting Officer*

*Commissioner of Patents and Trademarks*